US007607966B1

(12) United States Patent
Fox

(10) Patent No.: US 7,607,966 B1
(45) Date of Patent: Oct. 27, 2009

(54) BREAST UPLIFT SUPPORT ASSEMBLY

(76) Inventor: Leslie Z. Fox, 2712 Colby Ave., West Los Angeles, CA (US) 90064

( * ) Notice: Subject to any disclaimer, the term of this patent is extended or adjusted under 35 U.S.C. 154(b) by 18 days.

(21) Appl. No.: 11/998,773

(22) Filed: Dec. 3, 2007

(51) Int. Cl.
*A41C 3/00* (2006.01)

(52) U.S. Cl. ..... 450/63; 450/60; 450/56; 450/55

(58) Field of Classification Search ..... 450/60–63, 450/55, 56, 59
See application file for complete search history.

(56) References Cited

U.S. PATENT DOCUMENTS

| | | | | |
|---|---|---|---|---|
| 1,026,326 | A * | 5/1912 | Leporin | 450/56 |
| 2,175,676 | A * | 10/1939 | Walters | 450/63 |
| 2,734,193 | A * | 2/1956 | Croxall | 450/63 |
| 2,826,202 | A | 3/1958 | Star | |
| 5,098,330 | A | 3/1992 | Greenberg | |
| 5,347,656 | A | 9/1994 | Fabritz et al. | |
| 5,522,892 | A | 6/1996 | Lin | |
| 5,833,515 | A | 11/1998 | Shahbazian et al. | |
| 6,058,507 | A | 5/2000 | Klimenko | |
| 6,080,037 | A | 6/2000 | Lee et al. | |
| 6,302,760 | B1 | 10/2001 | Dai | |
| 6,811,463 | B2 | 11/2004 | Martz | |
| 7,056,187 | B2 * | 6/2006 | Cassity | 450/88 |

* cited by examiner

*Primary Examiner*—Gloria Hale
(74) *Attorney, Agent, or Firm*—Albert O. Cota

(57) ABSTRACT

A breast uplift support assembly (10) that is used in combination with a brassiere (70) having a right support cup (72) and a left support cup (78). The breast uplift support assembly (10) consists of a right uplift support (12) and a left uplift support (13). Each of the uplift supports (12,13) have inner and outer adjustable straps (24,42,25,43), inner and outer length adjustment means (26,44,27,45), inner and outer support attachment means (28,46,29,47), and inner and outer brassiere attachment means (30,48,31,48). Each uplift support (12,13) is designed to fit onto and be adjustably attached to the lower section of one of the brassiere's respective support cups (72,78), thereby providing an increase in the lifting and support capabilities of the brassiere (70).

1 Claim, 4 Drawing Sheets

BREAST UPLIFT SUPPORT ASSEMBLY

TECHNICAL FIELD

The invention generally pertains to the field of brassieres, and more particularly to a breast uplift support that is used in combination with a conventional brassiere to provide improved breast lifting and support.

BACKGROUND ART

Ever since Mary Phelps Jacob invented the first commercially successful brassiere in 1910, women throughout the world have utilized the brassiere as an essential undergarment. Although some argued that a brassiere did not offer as much support (and concealment) as the corset that it replaced, the brassiere's ease of putting on and increased comfort firmly established it as the preferred choice.

As a result of their inherently simple design, brassieres have not changed dramatically since their introduction. The most common improvements have been in the way that a brassiere is closed together and in the adjustability of the straps used to maintain a brassiere in place.

Unfortunately, even though brassieres are made in many sizes and styles to accommodate the multitude of varying breast sizes, there are certain women who are not provided sufficient support by a conventional brassiere. These women mostly comprise those who have large breasts and those whose breasts have begun to sag as a result of age. For many of these women this is more than just an inconvenience, as significant problems, especially those related to a women's back, can arise.

What is needed is a means by which a woman can improve an existing brassiere, even those brassieres specially designed for large and/or sagging breasts. The improvement must be on add-on device, so that a woman can utilize her existing brassieres. The improvement must be easy to use, unobtrusive and comfortable to wear, but-also must provide a significant increase in the lifting and support capabilities of the brassiere with which its utilized.

A search of the prior art did not disclose any patents that read directly on the claims of the instant invention, however the following U.S. patents are considered related:

| U.S. PAT. NO. | INVENTOR | ISSUED |
|---|---|---|
| 5,098,330 | Greenberg | Mar. 24, 1992 |
| 5,522,892 | Lin | Jun. 4, 1996 |
| 6,080,037 | Lee, et al | Jun. 27, 2000 |

The U.S. Pat. No. 5,098,330 discloses a breast enhancement brassiere wherein each of the breast cups has an inner pocket which receives a padding material and an outer pocket which receives a removable elastomeric member. A support wire extends along the lower curved edge of each cup and the upper edge of each cup has a relatively unconstrained open zone. The brassiere, when worn, exerts forces on the wearer's breasts, thereby lifting both breasts upward and inward toward each other.

The U.S. Pat. No. 5,522,892 discloses a breast augmentation device made from flexible rubber, having a breast-shaped front part and a hollow, rounded rear part for covering the breast. The rear part has a plurality of elongated grooves with vent holes and a plurality of elongated ribs, with each elongated groove having at least one end perpendicularly connected to the periphery of the orifice of the hollow, rounded rear part. Each elongated rib also has a center portion and two opposite ends that extend from the center portion and perpendicularly connect to the periphery of the orifice.

The U.S. Pat. No. 6,080,037 discloses a pneumatically adjustable brassiere that re-shapes drooping or small breasts. The brassiere includes conventionally shaped cups that are respectively composed as an integral body, with a first tube made of soft synthetic resin containing a predetermined amount of ceramic material, antibiotics, and deodorizer particles and connected with feed valve. A second tube is separately connected to an air blowing pump. The feed valve includes a valve sheet for intake of air into the valve body with alternately opening inflow holes on the valve body, two highly elastic springs and corrugated air pumps to vibrate up and down according to a wearer's movement so as to automatically supply air to the first air tube. The second tube is able to inflate and deflate from the air blowing pump, thereby controlling the amount of air supplied to the second tube of each brassiere cup.

For background purposes and as indicative of the art to which the invention is related reference may be made to the remaining patents located in the search:

| U.S. PAT. NO. | INVENTOR | ISSUED |
|---|---|---|
| 2,826,202 | Star | Jan. 20, 1954 |
| 5,347,656 | Fabritz et al | Sep. 20, 1994 |
| 5,833,515 | Shahbazian et al | Nov. 10, 1998 |
| 6,058,507 | Klimenko | May 9, 2000 |
| 6,302,760B1 | Dai | Oct. 16, 2001 |
| 6,811,463B2 | Martz | Nov. 2, 2004 |

DISCLOSURE OF THE INVENTION

The breast uplift support assembly (BUSA) functions in combination with a conventional brassiere, which has a right support cup, a left support cup, right and left back straps, and right and left shoulder straps. The BUSA works in pairs, with a single uplift support designed to fit onto and be adjustably attached to the lower section of the brassiere's respective right or left support cup. Once the uplift supports are in place, the person wearing the brassiere will be provided with an increase in the lifting and support capabilities of the brassiere. This will tremendously assist a woman who has large breasts, or whose breasts sag, the results of which can cause a woman to have back pain, difficulty walking and other problems. The BUSA can provide the necessary lift and support to alleviate these problems.

In some cases, only a single uplift support will be utilized in either a brassiere's right support cup or left support cup. This may occur if one breast is larger than the other, or if a breast has been removed, such as during a mastectomy.

The BUSA is comprised of a right uplift support and a left uplift support. The right and the left uplift supports each have an outer edge, an inner edge, an outer surface and an inner surface. There are also right and left inner and outer adjustable straps, with each strap having length adjustment means as well as support and brassiere attachment means. The purpose of all of the straps is to allow each of the uplift supports to be adjustably attached and securely maintained in place on the lower section of the brassiere's respective right or left cup.

In view of the above disclosure, the primary object of the invention is to provide a breast uplift support assembly that can be easily placed and maintained on the lower section of a brassiere's support cup in order to provide an increase in the lifting and support capabilities of the brassiere.

In addition to the primary object, it is also an object of the invention to provide a breast uplift support assembly that:

- can be made in various sizes to accommodate large and small brassieres,
- can be made of various materials,
- can be adjustably attached to provide maximum comfort,
- can be made in various colors, such as white, black, fleshtone, etc.
- does not alter the appearance of the brassiere when worn,
- can be easily removed and cleaned,
- can be permanently attached to a brassiere, or sold as an integral element of a brassiere.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
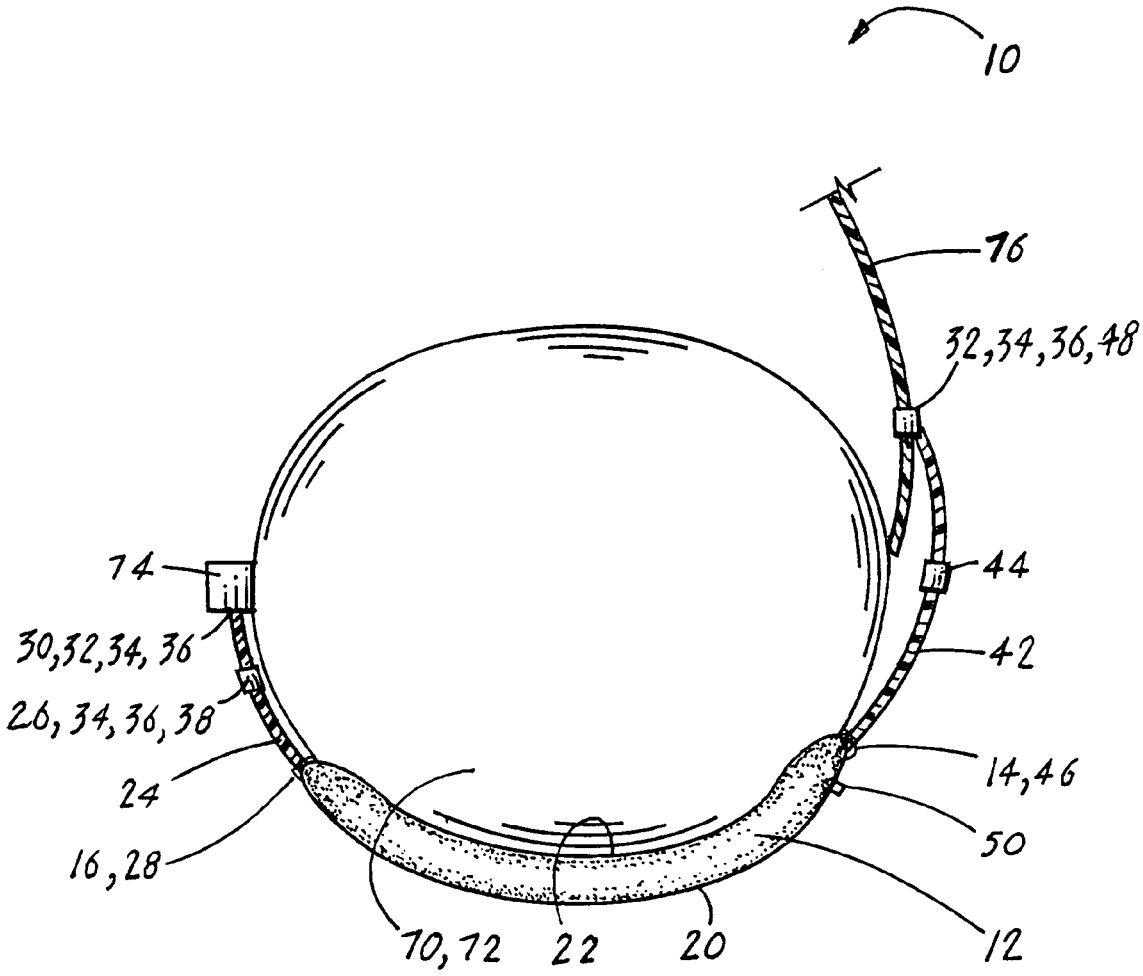
FIG. 1 is a front elevational view of a right uplift support.

The best mode for carrying out the invention is presented in terms of a preferred embodiment for a breast uplift support assembly 10, (hereinafter "BUSA 10"). The BUSA 10 functions in combination with a conventional brassiere and consists of at least one, and typically two, uplift supports. A single uplift support is designed to fit onto and be adjustably attached to the lower section of a brassiere's respective right or left support cup. Once the uplift supports are in place, the person wearing the brassiere will be provided with an increase in the lifting and support capabilities of the brassiere. This will significantly assist a woman who has large breasts, or whose breasts sag, the results of which can lead to a woman having back pain, difficulty walking and other problems.

As previously disclosed, the BUSA 10 functions in combination with a conventional brassiere 70 having a right support cup 72, a right back strap 74, a right shoulder strap 76, a left support cup 78, a left back strap 80, and a left shoulder strap 82.

As shown in FIGS. 1-4, the BUSA 10 is comprised of the following major elements: a right uplift support 12, a right inner adjustable strap 24, a right outer adjustable strap 42, a left uplift support 13, a left inner adjustable strap 25, and a left outer adjustable strap 43.

Figure 2:
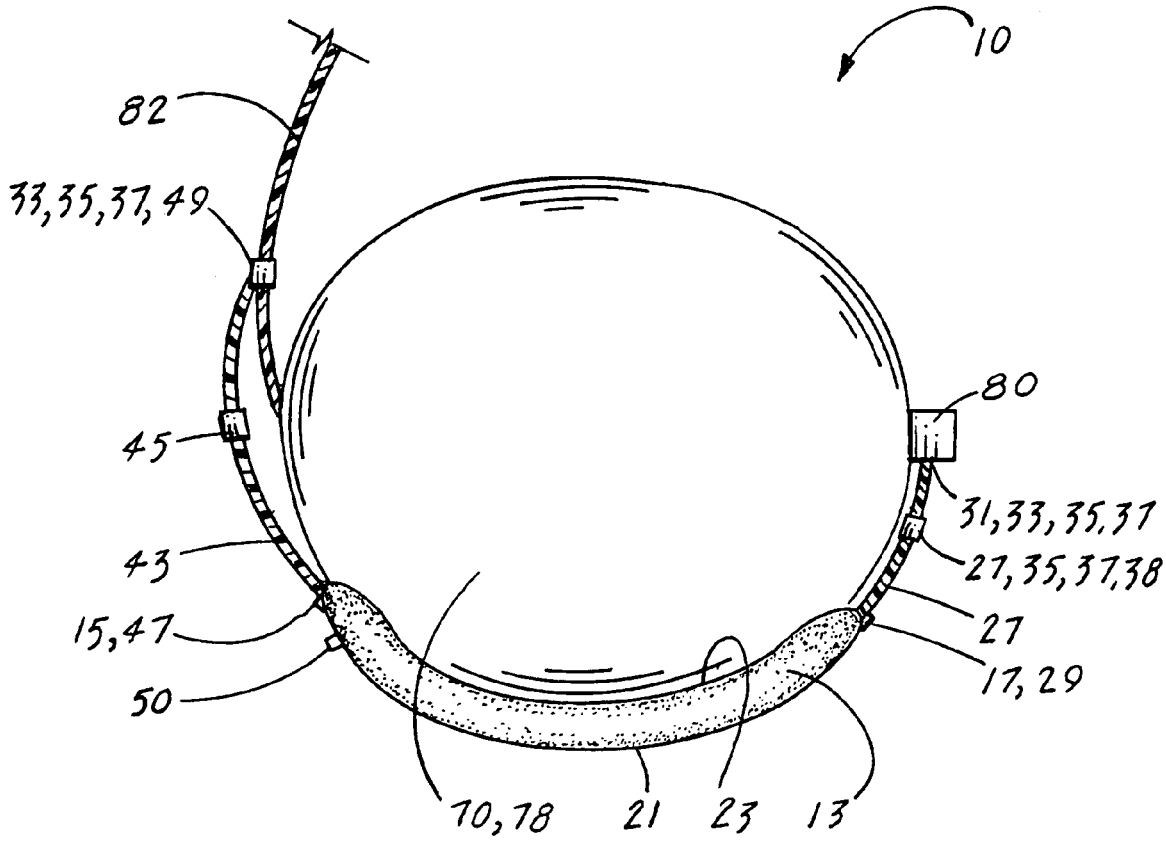
FIG. 2 is a front elevational view of a left uplift support.

The right uplift support 12 and the left uplift support 13 share the same design specifications and characteristics, as shown in FIGS. 1 and 2. In order to provide an accurate and complete disclosure, the right uplift support 12 and the left uplift support 13 have individual numerical element designations.

Figure 3:
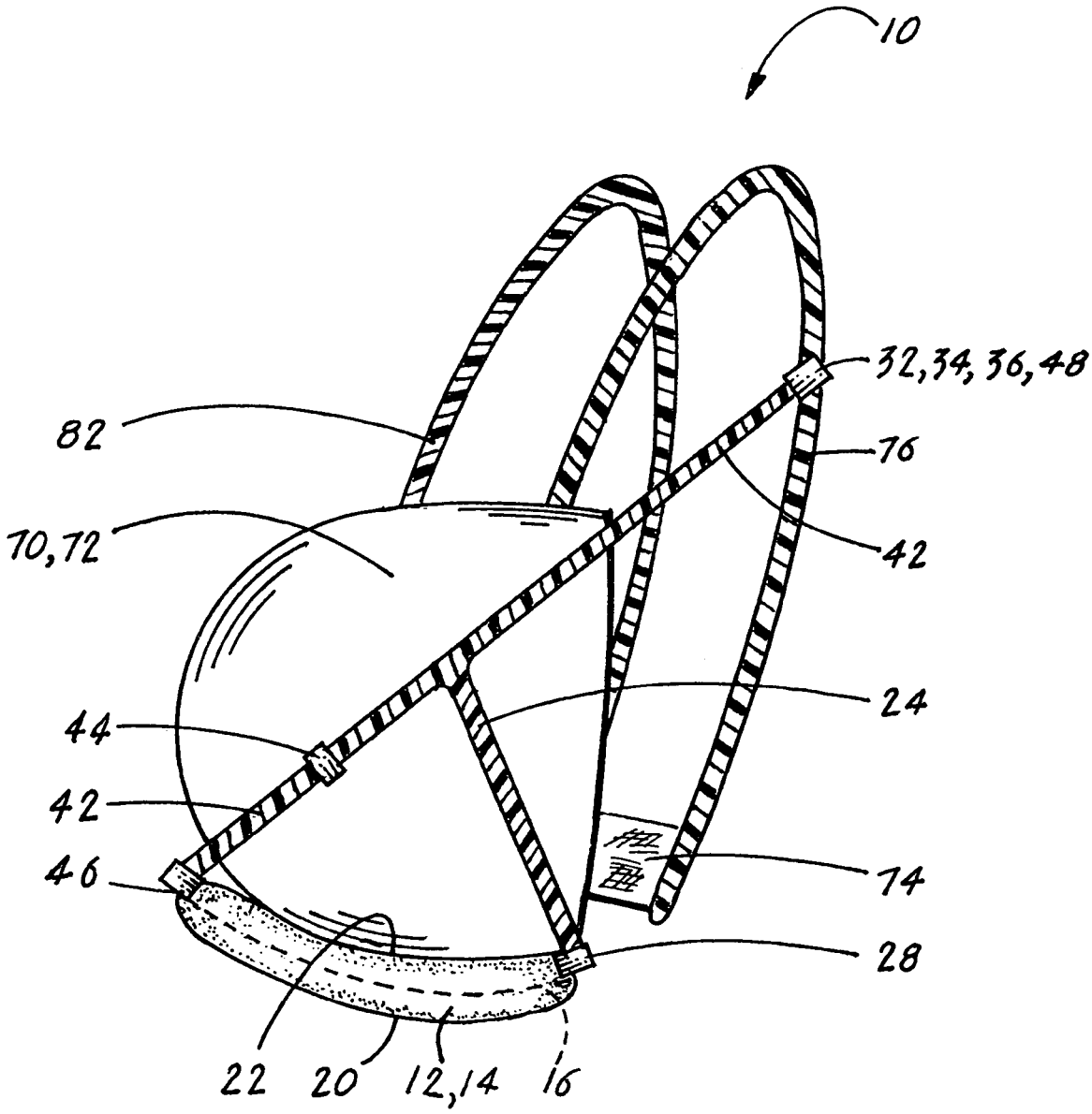
FIG. 3 is an elevational side view of the right uplift support with the left uplift support being a mirror image thereof.
Figure 4:
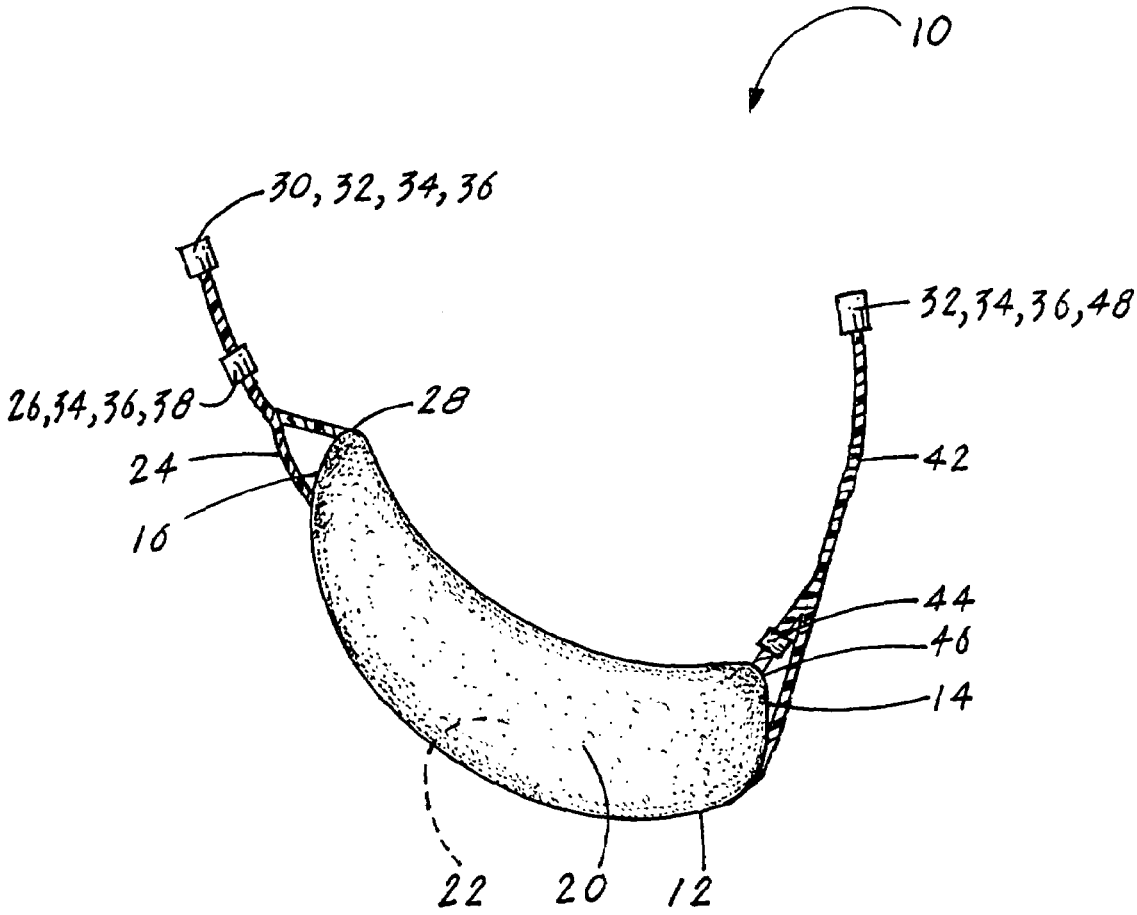
FIG. 4 is a perspective view of the breast uplift support assembly.

As shown in FIGS. 1, 3 and 4, the right uplift support 12 has an outer edge 14, an inner edge 16, an outer surface 20 and an inner surface 22. The right inner adjustable strap 24 has an inner length adjustment means 26, an inner support attachment means 28 and an inner brassiere attachment means 30. The right outer adjustable strap 42 has an outer length adjustment means 44, an outer support attachment means 46 and an outer brassiere attachment means 48.

As shown in FIG. 2, the left uplift support 13 is a mirror image of the right uplift support 12 and has an outer edge 15, an inner edge 17, an outer surface 21 and an inner surface 23. The left inner adjustable strap 25 has an inner length adjustment means 27, an inner support attachment means 29 and an inner brassiere attachment means 31. The left outer adjustable strap 43 has an outer length adjustment means 45, an outer support attachment means 47 and an outer brassiere attachment means 49.

For the right uplift support 12, the right inner and outer adjustable straps 24,42 adjustment and attachment means are comprised of a hook 32, as shown in FIGS. 1 and 4; complimentary snaps 34, as shown in FIGS. 1 and 4; or a hook and loop fastener (VELCRO®) 36, as shown in FIG. 1. Additionally, a buckle 38, as shown in FIG. 1, may be utilized as an adjustment means.

For the left uplift support 13, the left inner and outer adjustable straps 25,43 adjustment and attachment means are comprised of a hook 33, as shown in FIG. 2, complimentary snaps 35, as shown in FIG. 2; or a hook and loop fastener (VELCRO®) 37, as shown in FIG. 2. As with the right uplift support 12, a buckle 38, as shown in FIG. 2, may also be utilized by an adjustment means.

The right uplift support 12 and the left uplift support 13 are made of a solid material selected from the group consisting of rubber, vinyl, closed-cell foam, a synthetic resin, or a foam enclosed within a cloth cover. Alternatively, the right and the left uplift supports 12,13 can be comprised of a hermetic, hollow bladder that has attached, as shown in FIGS. 1 and 2, a one-way air valve 50. The valve 50 is used to inflate the bladder with a selectable quantity of a gas to provide a bladder firmness that is acceptable to the user of the BUSA 10. The gas can be selected from the group consisting of a liquid, air, oxygen or nitrogen.

The right inner and outer adjustable straps 24,42 and the left inner and outer adjustable strap 25,43 are made of a material selected from the group consisting of nylon, cotton, polyester, leather, vinyl or silk. Although the BUSA 10 is disclosed and described as comprising a right uplift support 12 and a left uplift support 13, with both uplift supports utilized concurrently, only a single uplift support can also be utilized. If desired or necessary a single uplift support can be adjustably attached onto either a brassiere's right support cup 72 or left support cup 78. This type of usage will typically occur if a woman has one breast that is larger that the other, or for a woman who has had a breast removed, such as during a mastectomy.

In order to adjustably attach the BUSA's 10 right uplift support 12 to a brassiere 70, the following steps are performed:

a) place a right uplift support adjacent the lower section of a brassiere, b) attach a right inner adjustable strap to the brassiere, c) adjust the length of the right inner adjustable strap by use of an inner length adjustment means, d) attach an inner support attachment means to the brassiere, e) attach an inner brassiere attachment means to the brassiere, f) attach a right outer adjustable strap to the brassiere, g) adjust the length of the right outer adjustable strap by use of an outer length adjustment means, h) attach an outer support attachment means to the brassiere, i) attach an outer brassiere attachment means to the brassiere, and j) repeat steps a)-i) for a left uplift support.

While the invention has been described in detail and pictorially shown in the accompanying drawings it is not to be limited to such details, since many changes and modifications may be made to the invention without departing from the spirit and the scope thereof Hence, it is described to cover any and all modifications and forms which may come within the language and scope of the claims.

BREAST UPLIFT SUPPORT ASSEMBLY

Designation Elements (For convenience of the Examiner, not part of the specification)

| | | | |
|---|---|---|---|
| 10 | Breast Uplift Support Assembly (BUSA) | 60 | |
| 12 | Right Uplift Support | 62 | |
| 14 | Outer Edge (Right) | 64 | |
| 16 | Inner Edge (Right) | 66 | |
| 18 | | 68 | |
| 20 | Outer Surface (Right) | 70 | Brassiere |
| 22 | Inner Surface (Right) | 72 | Right Support Cup |
| 24 | Right Inner Adjustable Strap (Right) | 74 | Right Back Strap |
| 26 | Inner Length Adjustment Means (Right) | 76 | Right Shoulder Strap |
| 28 | Inner Support Attachment Means (Right) | 78 | Left Support Cup |
| 30 | Inner Brassiere Attachment Means (right) | 80 | Left Back Strap |
| 32 | Hook (Right) | 82 | Left Shoulder strap |
| 34 | Complimentary Snaps | 84 | |
| 36 | VELCRO ® | | |
| 38 | Buckle | | |
| 40 | | | |
| 42 | Right Outer Adjustable Strap (Right) | | |
| 44 | Outer Length Adjustment Means (Right) | | |
| 46 | Outer Support Attachment Means (Right) | | |
| 48 | Outer Brassiere Attachment Means (Right) | | |
| 50 | Air Valve | | |
| 52 | | | |
| 54 | | | |
| 56 | | | |
| 58 | | | |
| 13 | Left Uplift Support | | |
| 15 | Outer Edge (left) | | |
| 17 | Inner Edge (left) | | |
| 21 | Outer Surface (Left) | | |
| 23 | Inner Surface (left) | | |
| 25 | Left Inner Adjustable Strap (Left) | | |

-continued

| | |
|---|---|
| 27 | Inner Length Adjustment Means (Left) |
| 29 | Inner Support Attachment Means (Left) |
| 31 | Inner Brassiere Attachment Means (Left) |
| 33 | Hook (left) |
| 35 | Complimentary Snaps |
| 37 | VELCRO ® |
| 43 | Left Outer Adjustable Strap (Left) |
| 45 | Outer Length Adjustment Means (Left) |
| 47 | Outer Support Attachment Means (Left) |
| 49 | Outer Brassiere Attachment Means (Left) |

The invention claimed is:

1. A breast uplift support assembly that functions in combination with a brassiere having a right support cup, a right back strap, a right shoulder strap, a left support cup, a left back strap, and a left shoulder strap, wherein said breast uplift support is comprised of:

a) a right uplift support having an outer edge, an inner edge, an outer surface and an inner surface, b) a right inner adjustable strap having an inner length adjustment means, an inner support attachment means and an inner brassiere attachment means, c) a right outer adjustable strap having an outer length adjustment means, an outer support attachment means and an outer brassiere attachment means, d) a left uplift support having an outer edge, an inner edge, an outer surface and an inner surface, wherein said right up-lift support and said left uplift support are comprised of a hermetic, hollow bladder that has attached a one-way air-valve that is used to inflate the bladder with a selectable quantity of a gas that is selected from the group consisting of a liquid, air, oxygen and nitrogen, e) a left inner adjustable strap having an inner length adjustment means, an inner support attachment means and an inner brassiere attachment means, and f) a left outer adjustable strap having an outer length adjustment means, an outer support attachment means and an outer brassiere attachment means, wherein said right uplift support and said left uplift support are designed to fit onto and be adjustably attached to the lower section of the brassiere's respective right cup and left cup, and wherein once the uplift supports are in place, the person wearing the brassiere will be provided with an increase in the lifting and support capabilities of the brassiere.

* * * * *